US005197159A

United States Patent [19]

Truong

[11] Patent Number: 5,197,159

[45] Date of Patent: Mar. 30, 1993

[54] CLEANING APPARATUS FOR PRODUCT SORTER VIEWING WINDOW

[75] Inventor: Thuan V. Truong, Houston, Tex.

[73] Assignee: Delta Technology Corporation, Houston, Tex.

[21] Appl. No.: 639,289

[22] Filed: Jan. 10, 1991

[51] Int. Cl.[5] ..... B06B 1/00; B06B 5/00

[52] U.S. Cl. ..... 15/304; 15/312.1; 15/316.1; 15/395

[58] Field of Search ..... 15/316.1, 312.1, 250 R, 15/304, 395, 71, 104.16; 250/223 R, 226, 227.11

[56] References Cited

U.S. PATENT DOCUMENTS

| | | | |
|---|---|---|---|
| 3,028,960 | 4/1962 | Currie et al. | 209/111.5 |
| 3,738,484 | 6/1973 | Hoover et al. | 209/73 |
| 3,800,358 | 4/1974 | Ryan | 15/395 X |
| 3,914,601 | 10/1975 | Hoover et al. | 209/111.7 |
| 4.028,136 | 6/1977 | Kamp | 15/312.1 X |
| 4,057,146 | 11/1977 | Castaneda et al. | 209/75 |
| 4,169,299 | 10/1979 | Bandoh | 15/312.1 |
| 4,454,029 | 6/1984 | Codding | 209/581 |
| 4,513,868 | 4/1985 | Culling et al. | 209/581 |
| 4,543,684 | 10/1985 | Bandoh et al. | 15/312.1 X |
| 4,697,709 | 10/1987 | Codding | 209/549 |
| 4,699,274 | 10/1987 | Saika | 209/587 |
| 4,976,002 | 11/1990 | Leonov et al. | 15/395 X |

FOREIGN PATENT DOCUMENTS

| | | | |
|---|---|---|---|
| 85/02565 | 6/1985 | PCT Int'l Appl. | 15/304 |
| 2136957A | 9/1984 | United Kingdom . | |

OTHER PUBLICATIONS

"DSB-201 Bichromatic Color Sorter" Delta Technology Corp. (assignee of the invention described in this app.), 1983.

"Model DSX-404 Multichannel Ratiometric/Bichromatic Color Sorter," Delta Technology Corp., 1986.

"Models DSR-114 and DSR-214 Color Sorters," Delta Technology Corp., 1986.

"Model DSM-HRS Monochromatic Scanner," Delta Technology Corp., 1986.

"Model DSRM-600 Superscan," Delta Technology Corp., 1987.

*Primary Examiner*—Chris K. Moore

*Attorney, Agent, or Firm*—Pravel, Gambrell, Hewitt, Kimball & Krieger

[57] ABSTRACT

Apparatus for cleaning a viewing surface of a product sorter viewer, the apparatus, in one embodiment, having a movable body for supplying air under pressure to the surface to remove debris or dust; and, in another embodiment, a viewer cleaning aparatus having a movable body with a cleaning element for contactingly cleaning a viewer surface such as a viewer window or optical fiber end. In one aspect a device according to this invention has a cleaning element that conforms in shape to the shape of a viewing surface.

8 Claims, 3 Drawing Sheets

CLEANING APPARATUS FOR PRODUCT SORTER VIEWING WINDOW

BACKGROUND OF THE INVENTION

1. Field Of The Invention

This invention is directed to a cleaning apparatus for cleaning a surface and, in one aspect, to such an apparatus for cleaning a viewing surface or window or optical fiber end such as those used in object and product sorters.

2. Description Of Related Art

Product sorters for sorting objects such as diamonds, peanuts, coffee beans, and grains are old and well known. Many of these sorters employ a viewing surface, a window or a surface of an optical fiber end past or through which pass the objects to be sorted. The surface or window is part of a viewing device which views light reflected from each object.

A typical sorter using a plurality of light sources and optical viewing means is shown in U.S. Pat. No. 3,914,601. A typical sorter using light conducting rods is shown in U.S. Pat. No. 4,057,146.

Often there is foreign material, debris, or dust which is intermingled with the objects to be sorted. Some of this unwanted material can remain on the viewing surface or rod ends, inhibiting viewing and resulting in false signals from the viewing apparatus. Prior art efforts to clean the viewing surfaces, windows or fiber ends have included the disposition of air nozzles immovably fixed above a window to provide blasts of compressed air against the window to dislodge unwanted material (U.S. Pat. No. 3,914,601); and an air inlet secured near the ends of optical fibers to provide air under pressure to prevent dust and debris from masking the fiber ends (U.S. Pat. No. 4,057,146).

Previous solutions to the cleaning problem, however, require a relatively large amount of air which itself may contain debris, dust, or oil. Also, an air blast may project residue or material from an object to be sorted onto a surface or window (e.g. oily residue from a peanut). In one previous attempt to clean a viewer window, a tubular ring was immovably disposed above the window, the ring having a plurality of holes around it through which air under pressure was directed through the window. It is also known in the prior art to position brushes against a viewer glass and to move the glass (not the brushes) to clean the glass.

There has long been a need for a product sorter viewer cleaning apparatus which adequately cleans substantially all of the viewing surface or rod end surface. There has long been a need for such a cleaning apparatus which cleans contactingly with means other than or in addition to air blasts. There has long been a need for such apparatuses which clean both with air and with a cleaning element that contacts the surface to be cleaned. There has long been a need for such apparatus which uses relatively little air. There has long been a need for cleaning apparatus for object sorters which continuously inhibits the deposition of unwanted material on surfaces of viewing devices themselves or on transparent surfaces (e.g. windows) interposed between the viewing device and objects to be sorted.

SUMMARY OF THE PRESENT INVENTION

The present invention, in one embodiment, is directed to a cleaning apparatus for a surface of a translucent window of a product sorter's viewer which has a body that is movable on or through the window, the body having one or more air inlets and one or more air outlets so that air under pressure is conveyed through the body and to an outlet (or outlets) near a surface to be cleaned. A selectively actuable air cylinder having a movable piston connected to the body can provide desired movement of the body with respect to the window. Of course any suitable device for moving the body with respect to the window may be employed (e.g. manually, gear-driven rod, solenoid, etc.).

The air cylinder can be mounted to a bracket which is securable to a viewer housing so that the body is disposed above or adjacent the surface or window to be cleaned without impeding the flow of objects through the sorter.

In one embodiment, the apparatus according to this invention is as described above with a cleaning element (e.g., cloth, brush or pad) attached to the body for contacting the surface to be cleaned. The cleaning element may completely surround the body or cover only a portion of it. It may be made from any suitable cleaning material (e.g. cloth, Velcro (TM) material, gauze, etc.). Cleaning fluid may be injected with the air onto the surface or window or introduced onto the cleaning element.

In one embodiment of a cleaning apparatus according to this invention which employs both air under pressure and a cleaning element, an air discharge orifice may be disposed on the body which surrounds the body so that air is directed out from the body in all directions. This is useful, e.g., when a cylindrical window is being cleaned.

Air supplied to the body may be independent of air supplied to an actuating air cylinder. Air may be supplied continuously through the body (whether the body is moving or not) to continuously inhibit the deposition of material on the window or the surface.

It is, therefore, an object of the present invention to provide new, useful, unique, efficient, safe and effective apparatuses for cleaning a viewing surface or optical fiber end of a product sorter.

Another object of the present invention is the provision of such apparatuses which have a movable cleaning element for contactingly cleaning a surface.

Yet another object of the present invention is the provision of cleaning apparatuses for cleaning a product sorter viewing surface, viewing window or optical fiber ends which employs compressed air flow to assist in cleaning.

An additional object of the present invention is to provide such apparatuses with a movable ring with air flow to clean around a non-flat surface.

Another object of the present invention is the provision of such apparatuses in which a cleaning element is fashioned and disposed to clean a non-flat surface.

Yet another object of the present invention is the provision of such apparatuses in which cleaning fluid can be injected onto the surface with the air or separately onto the cleaning element.

A further object of the present invention is the provision of cleaning apparatus for object sorters which can intermittently or continuously provide an air flow past or against a viewing device itself or past or against a transparent or translucent surface interposed between the viewing device and objects to be sorted to inhibit the deposition of material thereon or to dislodge already-deposited material.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF EMBODIMENTS PREFERRED AT THE TIME OF FILING FOR THIS PATENT

Figure 1:
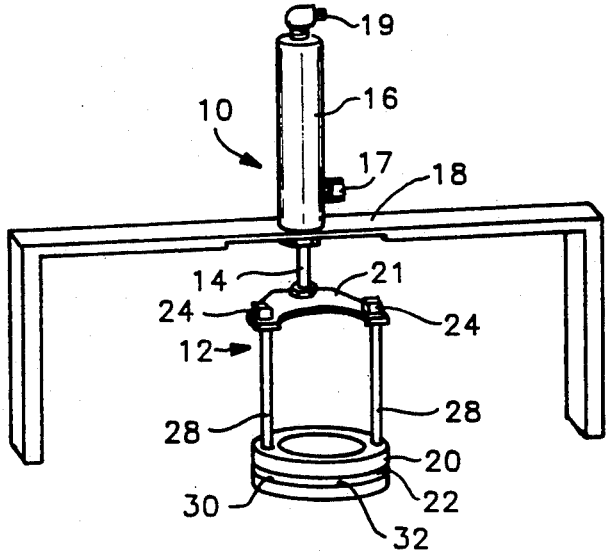
FIG. 1 is a perspective view of an apparatus according to the present invention.

Referring now to FIG. 1, a cleaning apparatus 10 according to the present invention has a body 12 with a top member 21 to which is secured a piston 14 of a selectively actuable air cylinder 16. Air under pressure flows through air inlets 17 and 19 to move the piston 14 up or down, respectively. The air cylinder 16 is secured to a bracket 18 which is mountable to or adjacent a product sorter viewer. A bottom member 20 is secured to hollow support tubes 28 of the body 12 and has a brush cleaning element 22 attached around it. In this embodiment, the bottom member 20 and the brush 22 are circular to accommodate a circular cylindrical viewer window; but it is within the scope of this invention to provide apparatuses for cleaning any surface, both flat, non-flat and tubular, i.e., cylindrical, polyagonal (e.g. pentagonal, hexagonal, triangular).

Air under pressure enters air inlets 24 through hoses or piping (not shown) which communicate with interior flow channels 26 in hollow support tubes 28. Air flows to outlets on an inner edge 30 of a groove 32 so that air is dispersed from substantially the entire 360 degree circumference of the bottom member.

Figure 2:
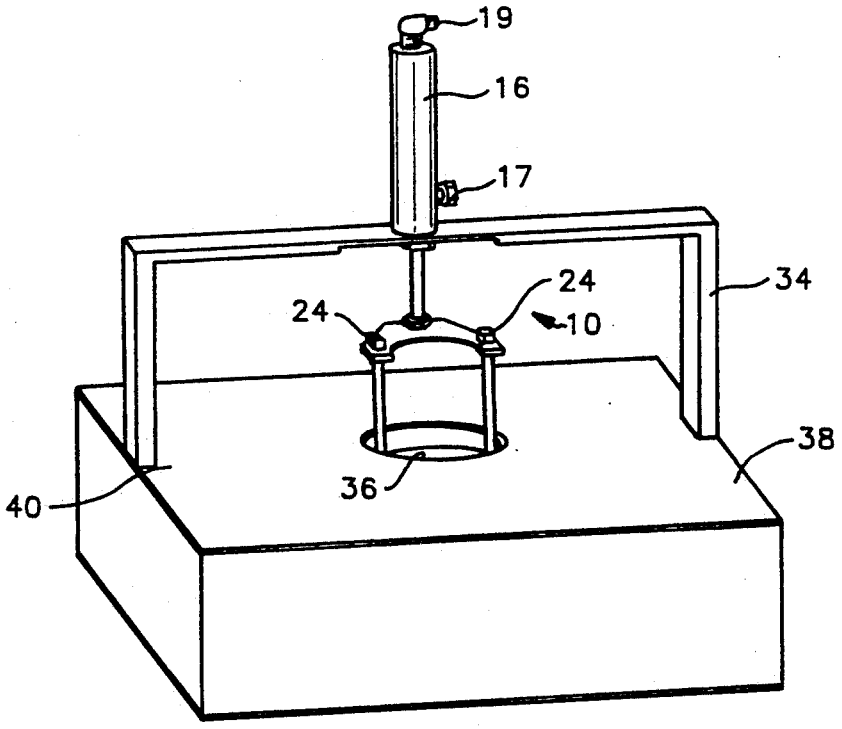
FIG. 2 is a perspective view of the apparatus of FIG. 1 secured to a viewer.

As illustrated in FIG. 2, the apparatus 10 secured to a bracket 34 is mounted in a window 36 of a viewed 38. The bracket 34 is secured to a viewer housing 40.

Figure 3:
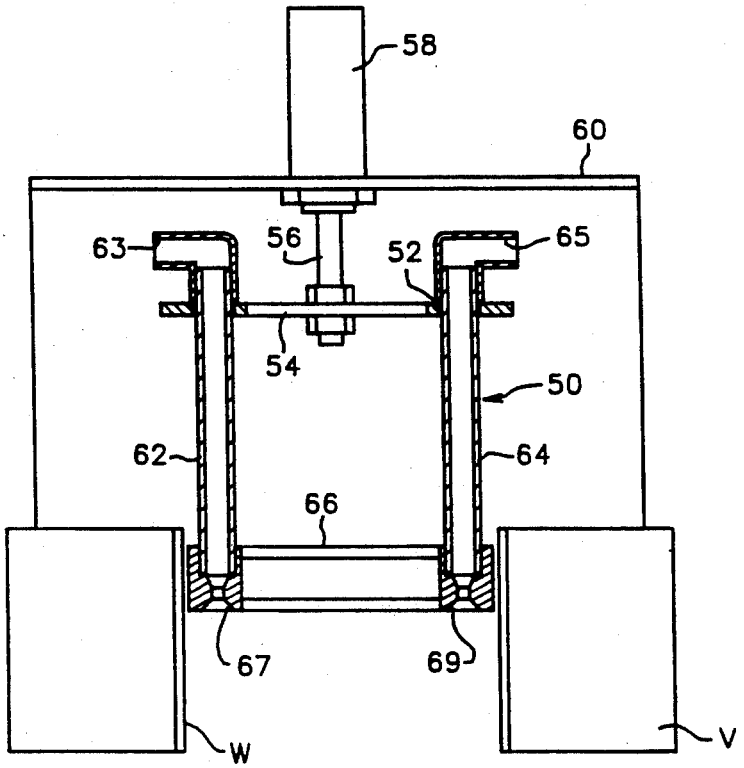
FIG. 3 is a cross-sectional view of an apparatus according to the present invention.

Referring now to FIG. 3, an apparatus 50 according to the present invention has a body 52 with a top plate 54 to which is secured a movable piston 56 of a selectively actuable air cylinder 58. The air cylinder 58 is secured to a mount member 60 (which can be like the bracket 34, FIG. 1). Two hollow support tubes 62 and 64 are connected to the top plate 54 and a bottom plate 66. Each of the tubes 62, 64 has an air inlet 63, 65, respectively. An air nozzle 67, 69 at the end of each tube 62, 64, respectively, provides an exit aperture for air for cleaning a window W of a viewer V. In a continuous operation mode, air exiting the nozzles continuously inhibits the deposition on the window W of material falling through the window. It is preferred that a continuous air flow be sufficiently large to inhibit the deposition of material on the surface yet sufficiently small that it does not adversely affect an air burst from an ejector.

Figure 4:
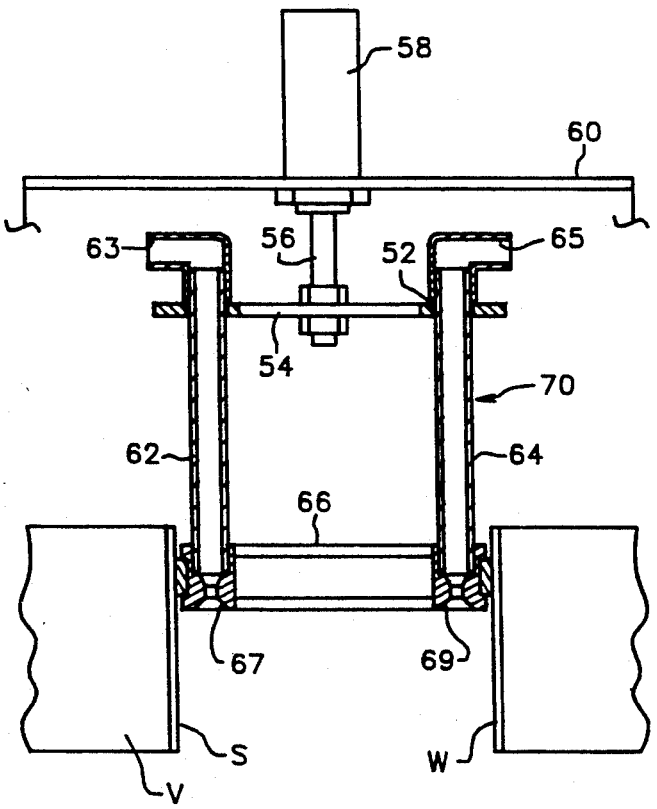
FIG. 4 is a cross-sectional view of an apparatus according to the present invention.

Referring now to FIG. 4, an apparatus 70 according to the present invention is similar to the apparatus 50 (FIG. 3) (in FIG. 4 like numerals as in FIG. 3 indicate like parts). The apparatus 70 has a brush cleaning element 72 surrounding the bottom plate 66. The brush cleaning element 72 contacts the surface S of the window W to directly and contactingly clean the surface S as the piston 56 moves the apparatus 70 past the surface S. Cleaning fluid may be directly applied to the cleaning element or injected into one or both of the air inlets to be sprayed onto the surface S.

Figure 5:
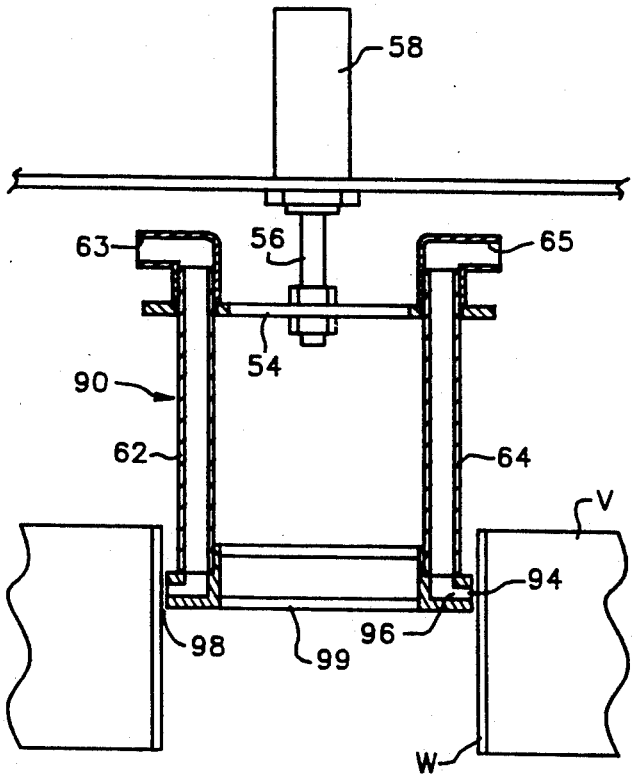
FIG. 5 is a cross-sectional view of an apparatus according to the present invention.

Referring now to FIG. 5, an apparatus 90 according to the present invention is similar to the apparatus 50 (FIG. 3), but has open exit ring 94 communicating with air flow through the hollow tubes 62 and 64 and which is directed more toward the window W than are the nozzles 67 and 69 (FIG. 1). It is preferred that an opening 96 to the ring 94 be about 0.050 inches and a gap 98 between a bottom plate 99 and the window W be about 0.060 inches.

Figure 6:
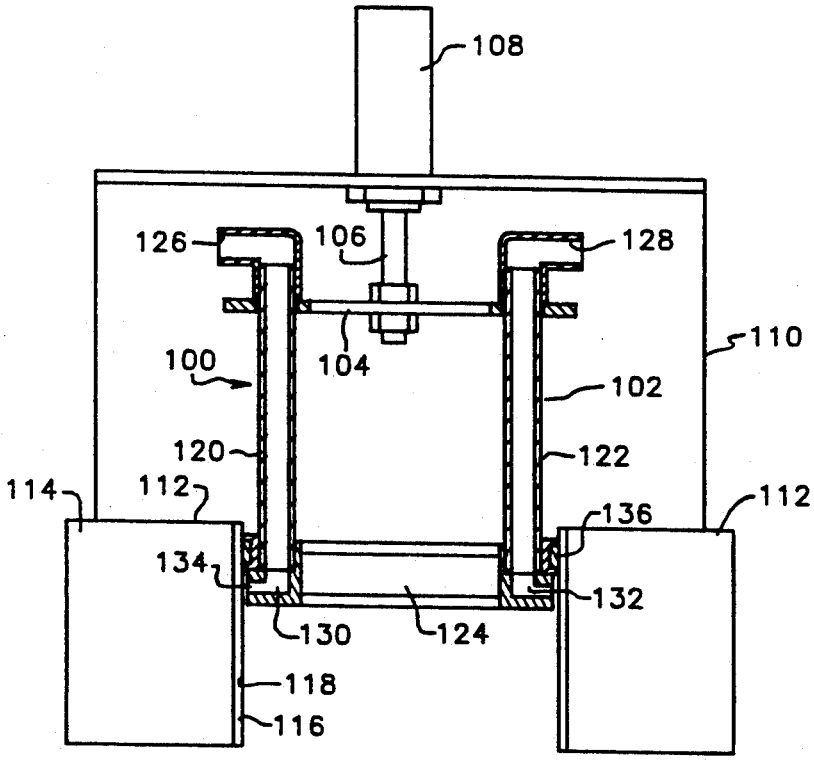
FIG. 6 is a cross-sectional view of an apparatus according to the present invention.

FIG. 6 illustrates an apparatus 100 according to the present invention having a body 102 with a top plate 104 to which is secured a movable piston 106 of a selectively actuable air cylinder 108. The air cylinder 108 is secured to a bracket 110 which itself is secured to a housing 112 of a product sorter viewer 114. The viewer 114 has a cylindrical window 116 with an interior surface 118. Two hollow tubes 120 and 122 are interconnected between the top plate 104 and a bottom member 124. Air under pressure enters air inlets 126 and 128 at the tops of the tubes 120 and 122, respectively, and exits through exit apertures 130 and 132, respectively, into a circular groove or open exit ring 134 around the bottom member 124, providing a ring of pressurized air around the apparatus 100 and against the window W. A cleaning element 136 also surrounds the bottom member 124 to contact and clean the surface 118 of the window W.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to claim the invention broadly in whatever form its principles may be utilized. The present invention is, therefore, well adapted to carry out the objects and obtain the ends and advantages mentioned, as well as others inherent therein.

What is claimed is:

1. Apparatus for cleaning an object sorter viewed window having a tubular viewed surface, the apparatus comprising a movable body member receivable within and movable adjacent the viewed window, a moving means for moving the movable body member, the body member having pressurized air conducting means extending therethrough, the pressurized air conducting means comprising a plurality of hollow tubes each extending from a top to a bottom of the body member, the plurality of hollow tubes each having an inlet opening for receiving air under pressure, and air exit aperture means in the body member in communication with the pressurized air conducting means, the air exit aperture means providing pressurized air flow to the viewer surface to clean it, the air exit aperture means comprising a plurality of nozzles, each of said plurality of nozzles being directed at a corresponding portion of the viewer surface, the nozzles being at a bottom end of each of the plurality of hollow tubes.

2. The apparatus of claim 1 wherein the window is cylindrical.

3. The apparatus of claim 1 comprising also cleaning element means secured to the movable body member for contactingly cleaning the viewer surface.

4. The apparatus of claim 3 wherein the cleaning element means is brush means which surrounds the body member.

5. The apparatus of claim 4 wherein the brush means is disposed above the air exit aperture means.

6. The apparatus of claim 1 wherein the plurality of nozzles are directed downwardly.

7. Apparatus for cleaning an object sorter viewer surface of a tubular viewer window, the apparatus comprising a movable body member mountable adjacent the viewer surface, a moving means for moving the movable body member within the tubular viewer window, the body member having pressurized air conducting means extending therethrough, the pressurized air conducting means comprising at least one hollow tube extending from a top to a bottom of the body member, the at least one hollow tube having an inlet opening for receiving air under pressure, and air exit aperture means in the body member in communication with the pressurized air conducting means, the air exit aperture means configured for continuously providing pressurized air flow to the viewer surface to clean it, the air exit aperture means comprising a nozzle extending around the entire periphery of said tubular viewer surface, the nozzle being connected to a bottom end of each of the at least one hollow tubes, cleaning element means secured to the movable body ember for contactingly cleaning the viewer surface, the cleaning element means comprising brush means surrounding the body member, the brush means disposed above the air exit aperture means.

8. Apparatus for cleaning a cylindrical viewer window of an object sorter, the apparatus comprising a body member mountable adjacent the window and movable into and out of the window, a moving means for moving the body member, the body member having pressurized air conducting means extending therethrough, the pressurized air conducting means comprising at least one hollow tube extending from a top to a bottom of the body member, the at least one hollow tube having an inlet opening for receiving air under pressure, air exit aperture means in communication with the pressurized air conducting means, the air exit aperture means being providing pressurized air flow directed against the viewer window to facilitate removal of material from the viewer window, the air exit aperture means having an open ring around a bottom potion of the body member through which the air flows toward the viewer window, cleaning element means secured to the movable body member and disposed above the air exit aperture means for contactingly cleaning the viewer window.

* * * * *